US008235740B2

(12) United States Patent
Tsai

(10) Patent No.: US 8,235,740 B2
(45) Date of Patent: Aug. 7, 2012

(54) ELECTRICAL CONNECTOR

(76) Inventor: Horng Yu Tsai, SinJhuang (TW)

( * ) Notice: Subject to any disclaimer, the term of this patent is extended or adjusted under 35 U.S.C. 154(b) by 0 days.

(21) Appl. No.: 12/860,894

(22) Filed: Aug. 22, 2010

(65) Prior Publication Data

US 2011/0045681 A1 Feb. 24, 2011

(30) Foreign Application Priority Data

Aug. 24, 2009 (TW) ..... 98215627 U

(51) Int. Cl.
*H01R 13/62* (2006.01)

(52) U.S. Cl. ..... 439/328; 439/372

(58) Field of Classification Search ..... 439/328, 439/325, 372, 157, 152, 160, 155
See application file for complete search history.

(56) References Cited

U.S. PATENT DOCUMENTS 5,484,302 A * 1/1996 Yamada et al. ..... 439/326
5,647,755 A * 7/1997 Hida et al. ..... 439/328
5,649,831 A * 7/1997 Townsend ..... 439/157
5,676,555 A * 10/1997 Yu et al. ..... 439/157
6,824,413 B1 * 11/2004 Shipe et al. ..... 439/326
7,677,907 B2 * 3/2010 Guan et al. ..... 439/157
2008/0220642 A1 * 9/2008 Guan et al. ..... 439/325

* cited by examiner

*Primary Examiner* — Tulsidas C Patel
*Assistant Examiner* — Travis Chambers
(74) *Attorney, Agent, or Firm* — Pro-Techtor Int'l Services

(57) ABSTRACT

An electrical connector includes a plastic base and an engaging member. The base has a longitudinally extended connection slot to be connected to a circuit board having one side formed with a notch. The engaging member disposed on one side of the base has an elastic arm, which has a handle, a guide-in inclined surface, an engaging portion and an elastic member. When the circuit board is inserted into the slot, the one side thereof presses the guide-in inclined surface to make the arm elastically move outwardly. When the arm elastically moves back, the engaging portion engages with the notch. When the handle is moved to make the arm elastically move outwardly and to disengage the engaging portion from the notch, the elastic member can stop the engaging member from elastically moving back to engage with the notch, so that the circuit board can be conveniently taken out.

13 Claims, 10 Drawing Sheets

ELECTRICAL CONNECTOR

BACKGROUND OF THE INVENTION

1. Field of the Invention

The invention relates in general to an electrical connector, and more particularly to an electrical connector to be connected to a circuit board.

2. Related Art

FIG. 1 shows a conventional electrical connector to be connected to a circuit board 20, which is a memory card having two sides each formed with notches 21 and 22 at different levels.

The electrical connector has a plastic base 10 and two engaging members 15. The top end of the engaging member 15 is formed with an engaging portion 16 projecting inwardly, and a pressing portion 17 projecting outwardly, and the lower segment of the engaging member 15 is formed with a lifting portion 18 projecting inwardly. A pivot portion 19 is disposed between the engaging portion 16 and the lifting portion 18. The pivot portion 19 is pivotally connected to one side of the plastic base 10. When the engaging portion 16 engages with the notch 21 on one side of the circuit board 20, the lifting portion 18 rests against the lower edge on the same side of the circuit board 20.

As shown in FIG. 2, when the circuit board 20 is to be taken out, two hands need to press the pressing portions 17 of the engaging members 15 on the two sides, so that the two engaging members 15 are rotated outwardly, the engaging portion 16 is disengaged from the notch 21 of the circuit board 20 and the lifting portion 18 lifts up the circuit board 20.

The convention design has the following drawbacks.

First, the two engaging members 15 are pivotally connected to two sides of the plastic base 10, and the manufacturing cost still cannot be effectively reduced.

Second, when the two engaging members 15 engage with the circuit board 20, the center of the pivot portion 19 is disposed outside an engaging edge 23 of the circuit board 20 and the engaging portion 16. Thus, when the up and down impact forces are applied, the engaging member 15 is rotated outwardly and disengaged from the circuit board 20.

SUMMARY OF THE INVENTION

It is therefor an object of the invention to provide an electrical connector having an engaging member, which can be elastically moved so that the structure is simple and the engagement is stable.

The invention achieves the above-identified object by providing an electrical connector including a plastic base and an engaging member. The plastic base extends longitudinally and has a longitudinally extended connection slot to be connected to a circuit board having one side formed with a notch. The engaging member disposed on one side of the plastic base has an elastic arm. The elastic arm has a handle, a guide-in inclined surface, an engaging portion and at least one elastic member. When the circuit board is inserted into the connection slot, the one side of the circuit board presses the guide-in inclined surface to make the elastic arm elastically move outwardly. When the elastic arm elastically moves back, the engaging portion engages with the notch of the circuit board. When the handle is moved to make the elastic arm elastically move outwardly and to disengage the engaging portion from the notch of the circuit board, the at least one elastic member can stop the engaging member from elastically moving back to engage with the notch, so that the circuit board can be conveniently taken out.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE INVENTION

The present invention will be apparent from the following detailed description, which proceeds with reference to the accompanying drawings, wherein the same references relate to the same elements.

Figure 1:
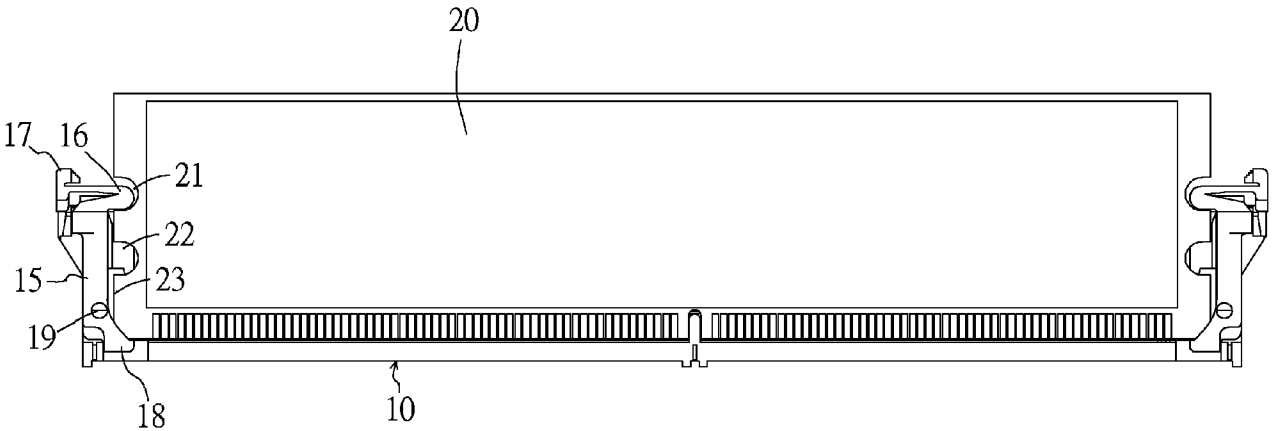
FIG. 1 (Prior Art)
FIG. 1 is a front view showing a conventional electrical connector engaged with a circuit board.
Figure 2:
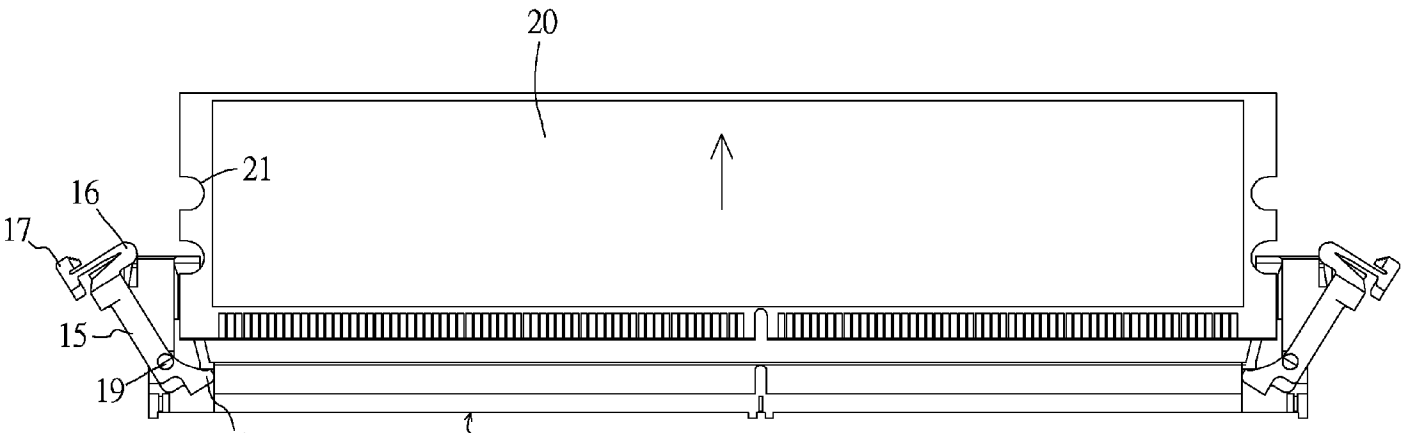
FIG. 2 (Prior Art)
FIG. 2 is a front view showing the conventional electrical connector disengaged from the circuit board.
Figure 3:
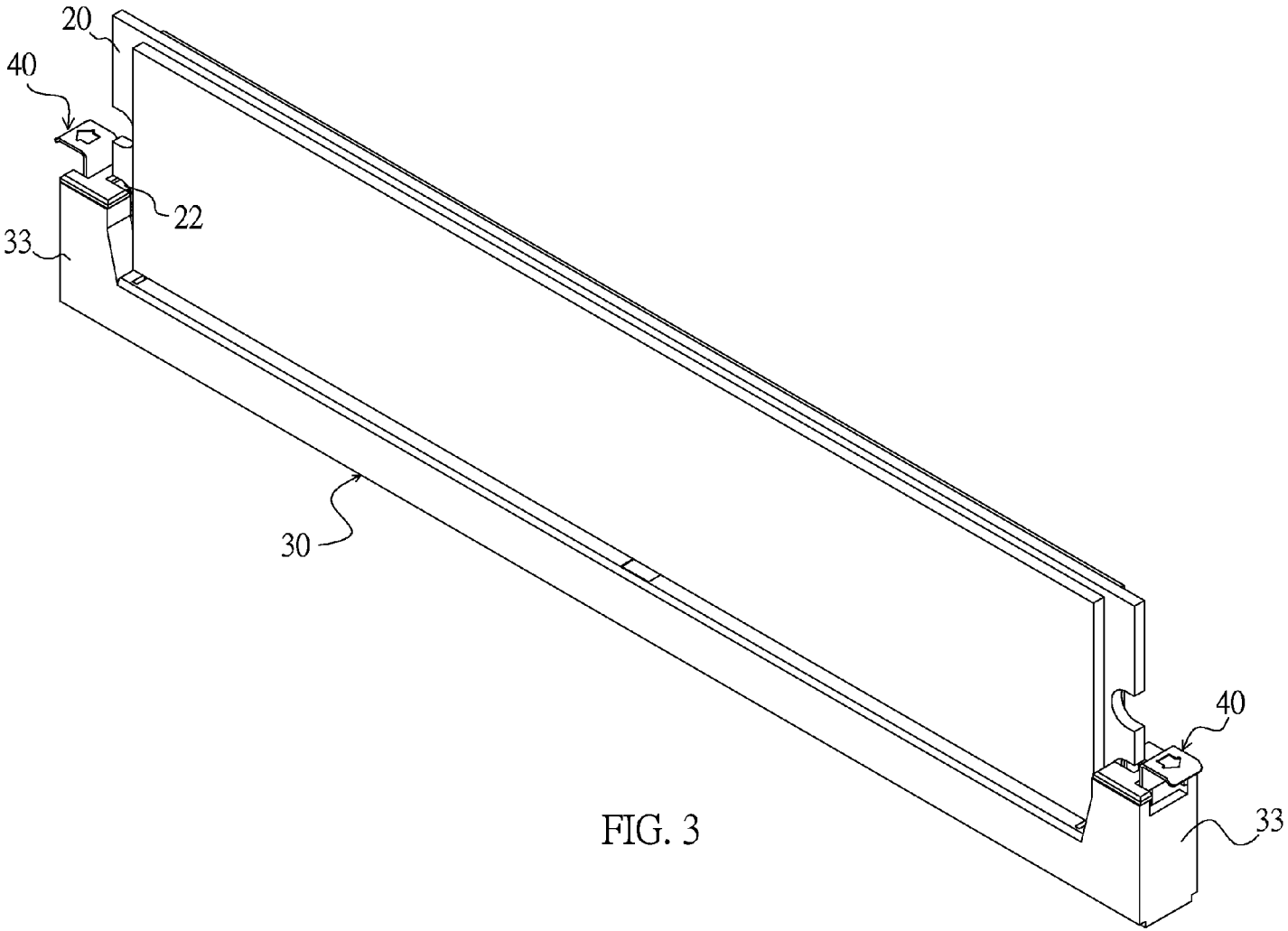
FIG. 3 is a pictorial view showing a first embodiment of the invention.
Figure 4:
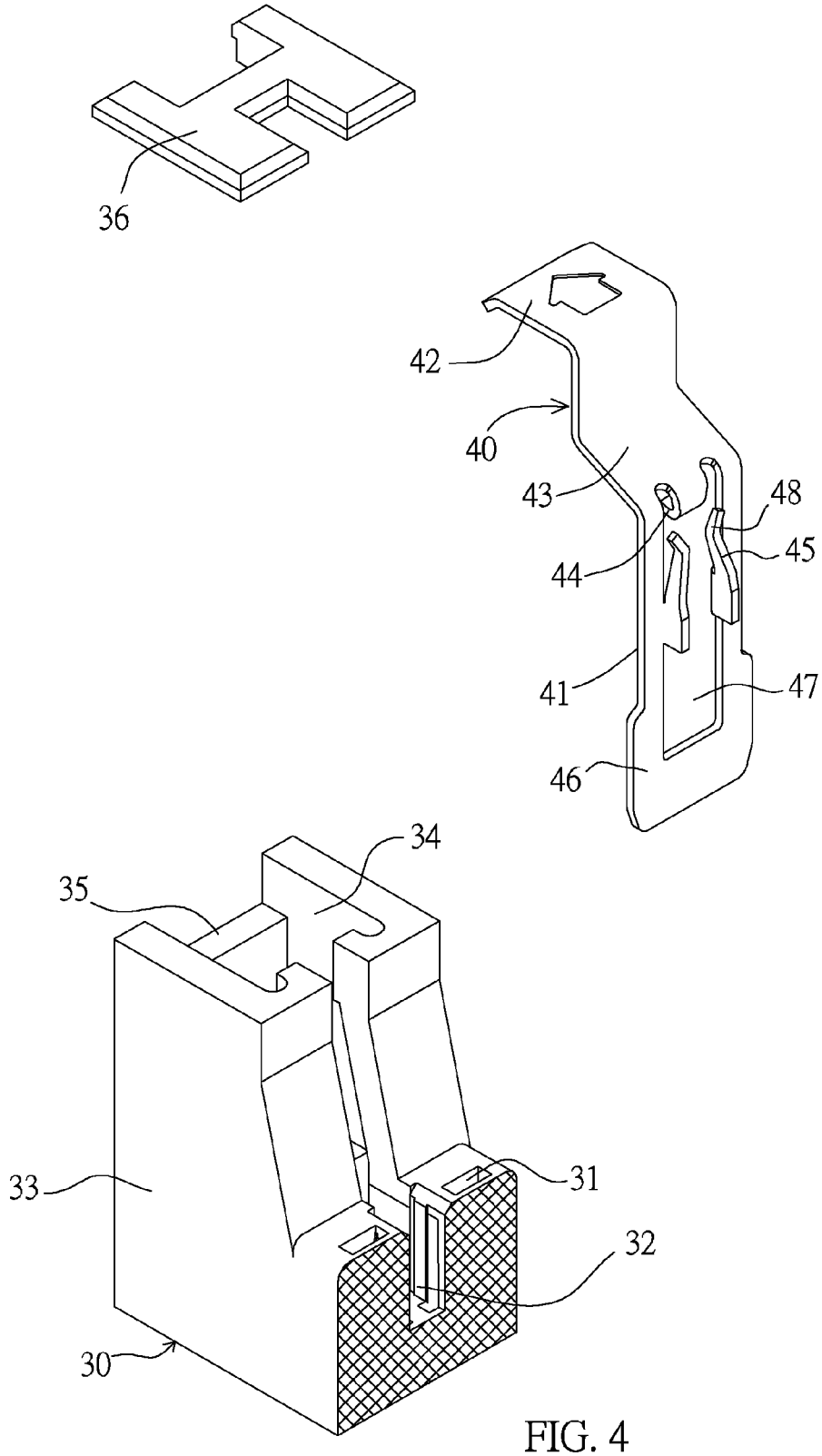
FIG. 4 is a pictorially exploded view showing the first embodiment of the invention.

Referring to FIGS. 3 and 4, a memory card connector according to the first embodiment of the invention includes a plastic base 30 and two engaging members 40 extending in a vertical direction.

The plastic base 30 extending longitudinally has two rows of terminal slots 31. A terminal is disposed in each terminal slot 31. A longitudinally extended connection slot 32 is formed between the two terminal slots 31. Two sides of the connection slot 32 are formed with two supporting seats 33, respectively. The supporting seats 33 are higher than the connection slot 32 and have two opposite surfaces so that the middle of the supporting seat 33 is formed with a connection chamber 34. The outer side of the supporting seat 33 is formed with a stopping surface 35, and the top end of the supporting seat 33 is formed with a resting plate 36.

The two engaging members 40 are respectively formed by bending two metal plates, and are respectively disposed on two sides of the plastic base 30. Each engaging member 40 has an elastic arm 41. The elastic arm 41 includes, from top to bottom, a handle 42, a guide-in inclined surface 43, an engaging portion 44, one pair of elastic members 45 and a fixing portion 46. The fixing portion 46 is disposed on the bottom end of the elastic arm 41 to fix the supporting seat 33 onto one side of the plastic base 30. The handle 42 is disposed on the top end of the elastic arm and projects outwardly. The bottom of the engaging portion 44 is formed with a longitudinal through hole 47. The one pair of elastic members 45 is formed by keeping the material when the longitudinal through hole 47 is being formed, and extends from top to bottom. The top end of the elastic member 45 is formed with a guide-in inclined surface 48.

Figure 5:
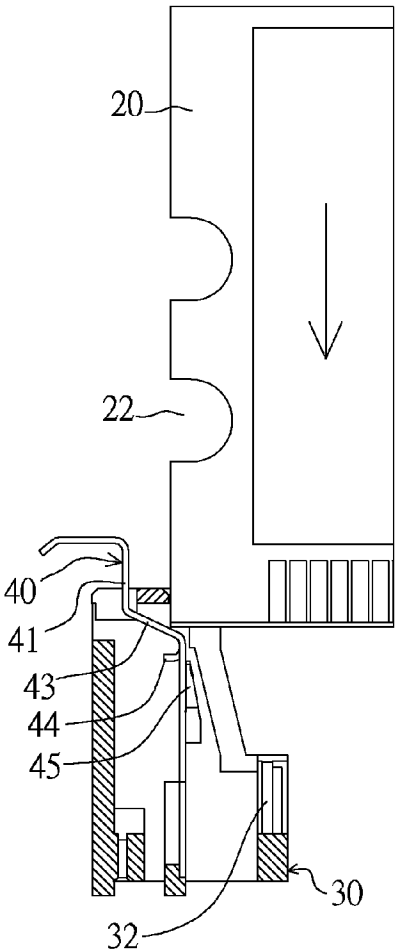
FIGS. 5 to 7 are front views showing the first embodiment of the invention when a circuit board is inserted.
Figure 6:
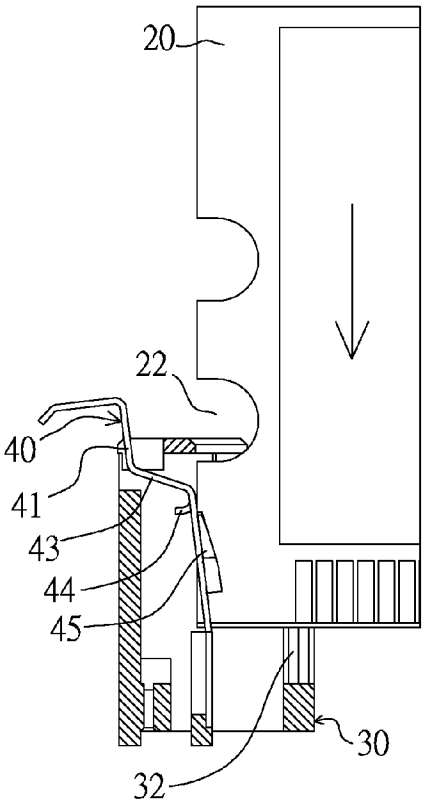
Figure 7:
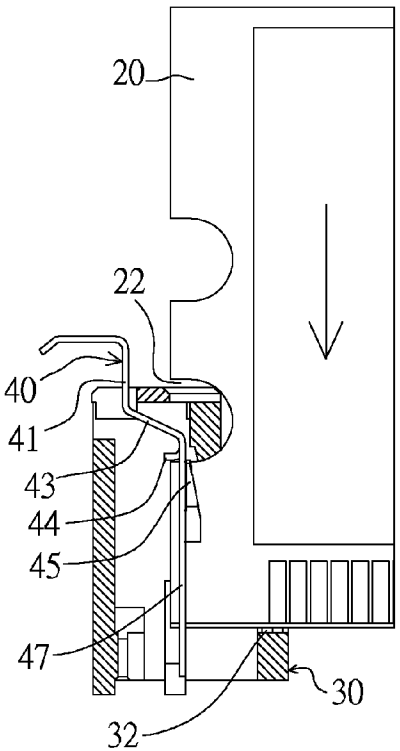

According to the above-mentioned structure, as shown in FIGS. 5 to 7, when the circuit board 20 is inserted, the lower edges of two sides of the circuit board 20 respectively press the guide-in inclined surface 43 of the engaging member 40 to make the elastic arm 41 elastically move outwardly and to make the elastic members 45 move elastically (see FIG. 8) so that the elastic members 45 can elastically press two plate surfaces of the circuit board 20 thereafter. When the elastic arm 41 elastically moves back, the engaging portion 44 engages with the notch 22 of the circuit board 20, the circuit board 20 is in an inserted state, as shown in FIG. 7, and the bottom of the notch 22 of the circuit board engages with the longitudinal through hole 47. Meanwhile, the pair of elastic members 45 elastically presses two plate surfaces of the circuit board 20, on which traces are formed or electronic elements are mounted.

Figure 10:
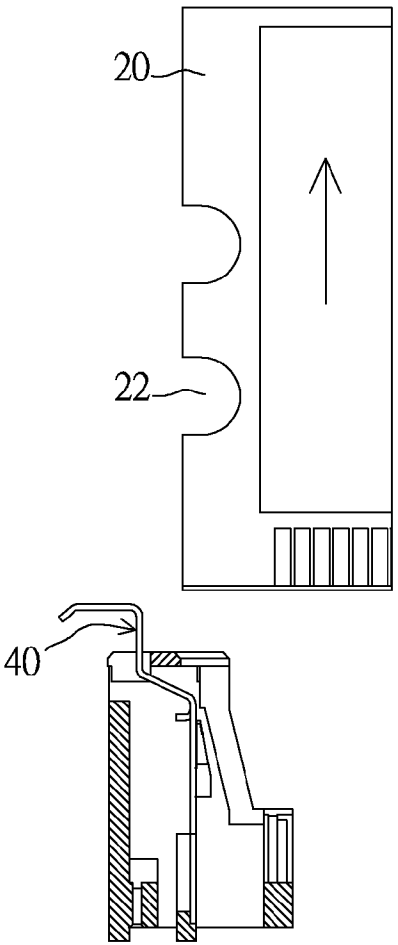
FIGS. 9 and 10 are front views showing the first embodiment of the invention when the circuit board is taken out.
Figure 9:
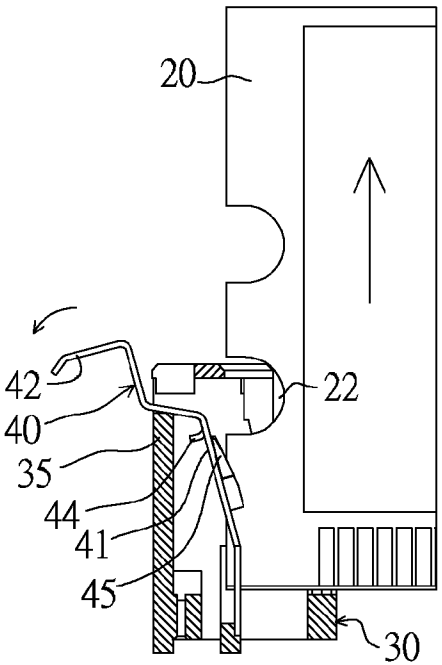
Figure 8:
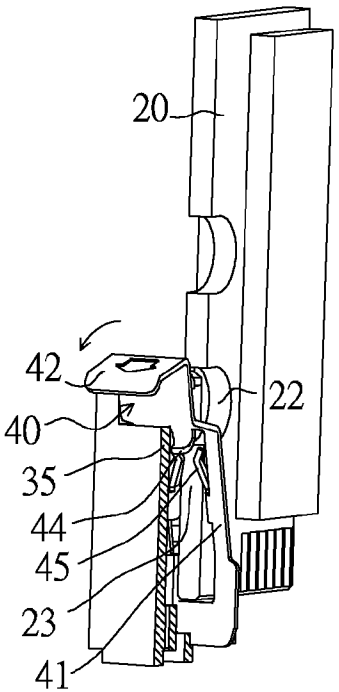
FIG. 8 is a pictorial view showing the first embodiment of the invention when the circuit board is taken out.

As shown in FIGS. 8 and 9, when the circuit board 20 is to be taken out, the handle 42 of the engaging member 40 is moved to make the elastic arm 41 elastically move outwardly and disengage the engaging portion 44 from the notch 22 of the circuit board 20 and the circuit board 20 is still in the inserted state, as shown in FIG. 9, wherein the state of the circuit board 20 of FIG. 9 is the same as that of FIG. 7. At this time, the plate surfaces of the pair of elastic members 45 cannot clamp the circuit board and elastically move back to press the engaging edge 23 on one side of the circuit board, so as to stop the engaging member 40 from elastically moving back so that the engaging portion 44 cannot engage with the notch 22. At this time, the handle 42 can be released, and the circuit board 20 can be pulled out. The stopping surface 35 can stop the elastic arm 41 to prevent the engaging member 40 from being over moved. As shown in FIG. 10, after the circuit board 20 is taken out, the engaging member 40 can elastically move back and return to the home position. Thus, the engaging member 40 elastically moves back after the circuit board 20 is taken out.

Figure 13:
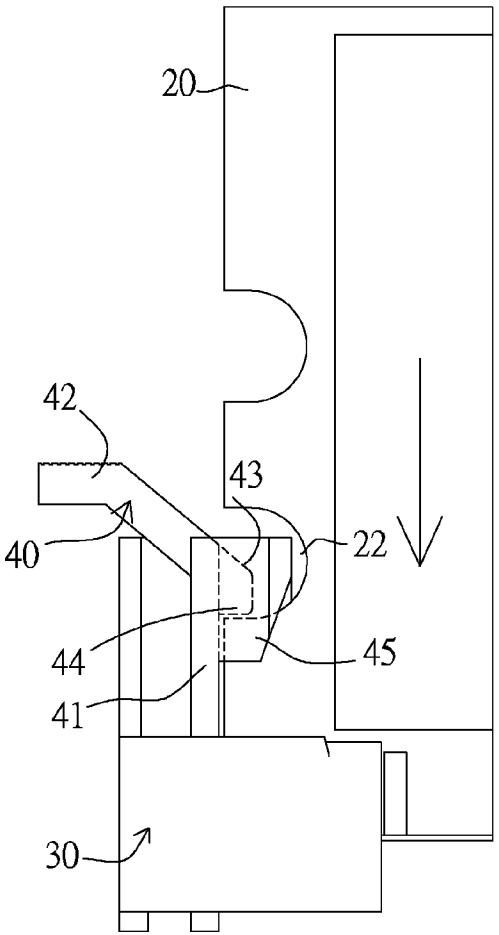
FIG. 13 is a front view showing that the circuit board is inserted into the positioning state with the supporting seat being cloven according to the second embodiment of the invention.
Figure 12:
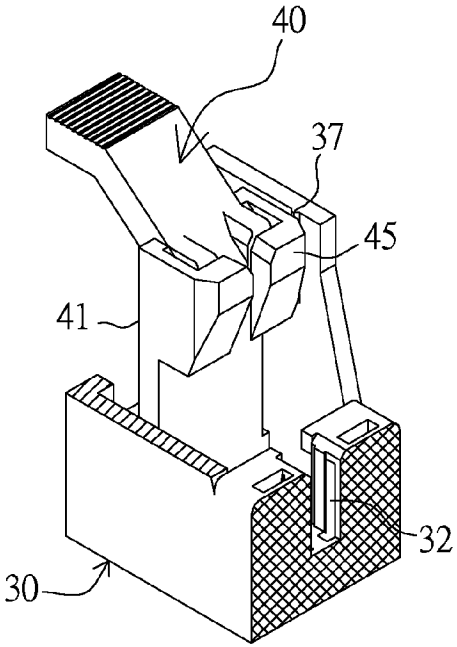
FIG. 12 is a pictorial view showing the second embodiment of the invention with a supporting seat being cloven.
Figure 11:
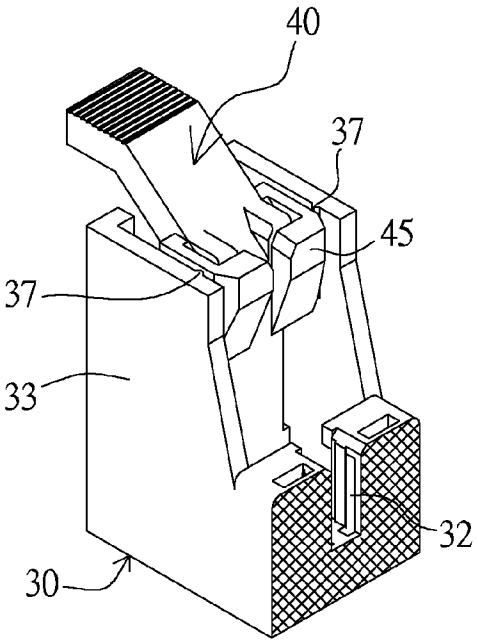
FIG. 11 is a pictorial view showing a second embodiment of the invention.

As shown in FIGS. 11 to 13, the second embodiment of the invention is substantially the same as the first embodiment except that the two engaging members 40 and the plastic base 30 are integrally formed by way of injection molding. The two engaging members 40 are respectively disposed in the supporting seats 33 on two sides of the plastic base 30. Each engaging member 40 similarly has an elastic arm 41. The elastic arm 41 has, from top to bottom, a handle 42, a guide-in inclined surface 43, an engaging portion 44 and one pair of elastic members 45. The inner edge of the top end of the supporting seat 33 is formed with a pair of projecting engaging points 37.

Figure 16:
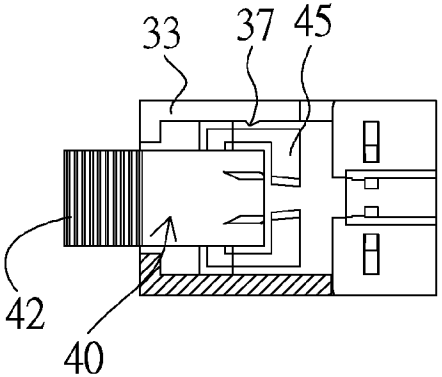
FIG. 16 is a top view showing that the circuit board is taken out with the supporting seat being cloven according to the second embodiment of the invention.
Figure 15:
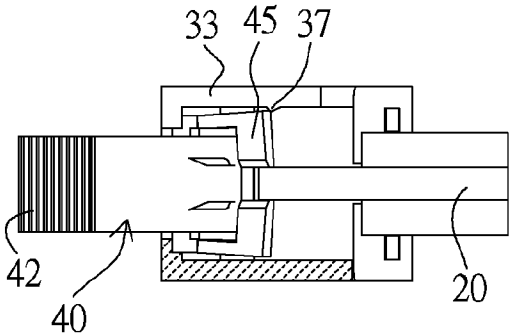
FIG. 15 is a top view showing that the circuit board is taken out with the supporting seat being cloven according to the second embodiment of the invention.
Figure 14:
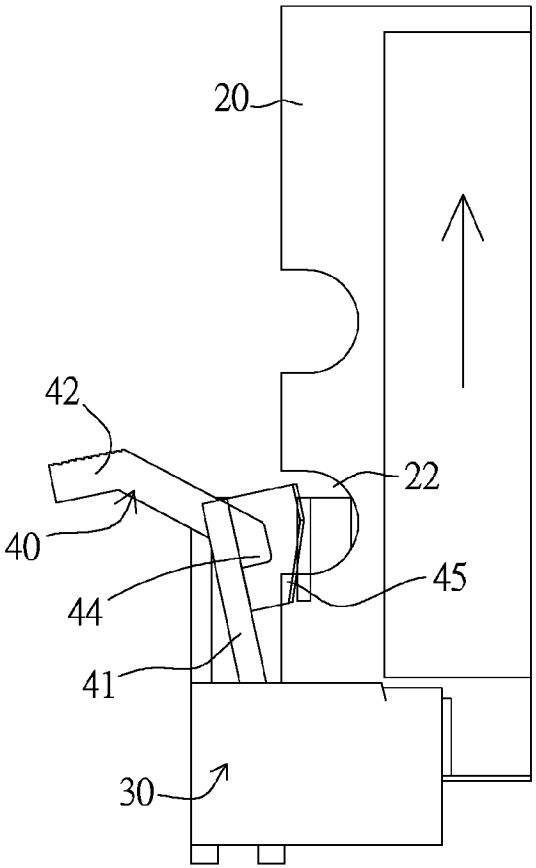
FIG. 14 is a front view showing that the circuit board is taken out with the supporting seat being cloven according to the second embodiment of the invention.

As shown in FIGS. 14 and 15, when the circuit board 20 is to be taken out, the handle 42 of the engaging member 40 is moved to make the elastic arm 41 elastically move outwardly so that the engaging portion 44 is separated from the notch 22 of the circuit board 20. At this time, the pair of elastic members 45 still clamps the plate surfaces of the circuit board 20, and the inner ends of the elastic members 45 are engaged with the pair of engaging points 37. Thus, the engaging member 40 cannot elastically move back to engage with the notch 22 of the circuit board. At this time, the handle 42 can be released, and the circuit board 20 may be pulled out. As shown in FIG. 16, after the circuit board 20 is taken out, the pair of elastic members 45 elastically moves back and cannot be engaged with the pair of engaging points 37. The engaging member 40 elastically moves back and returns to the home position.

The one pair of elastic members 45 of this embodiment is made of a plastic material, and may have the elastic fatigue after they clamp the circuit board 20 for a long time. As shown in FIG. 16, after the circuit board 20 is taken out and if the one pair of elastic members 45 cannot elastically move back, the elastic members 45 do not have the tension for clamping the circuit board. So, the engaging member 40 may be forced to pass through the engaging point 37 and thus elastically move back due to the elastic force of the elastic arm 41.

According to the above-mentioned descriptions, it is obtained that the engaging member 40 of the invention has the simple structure, can save the manufacturing costs and can have the good reliability when it is either integrally made of the metal material or integrally formed with the plastic base.

Figure 17:
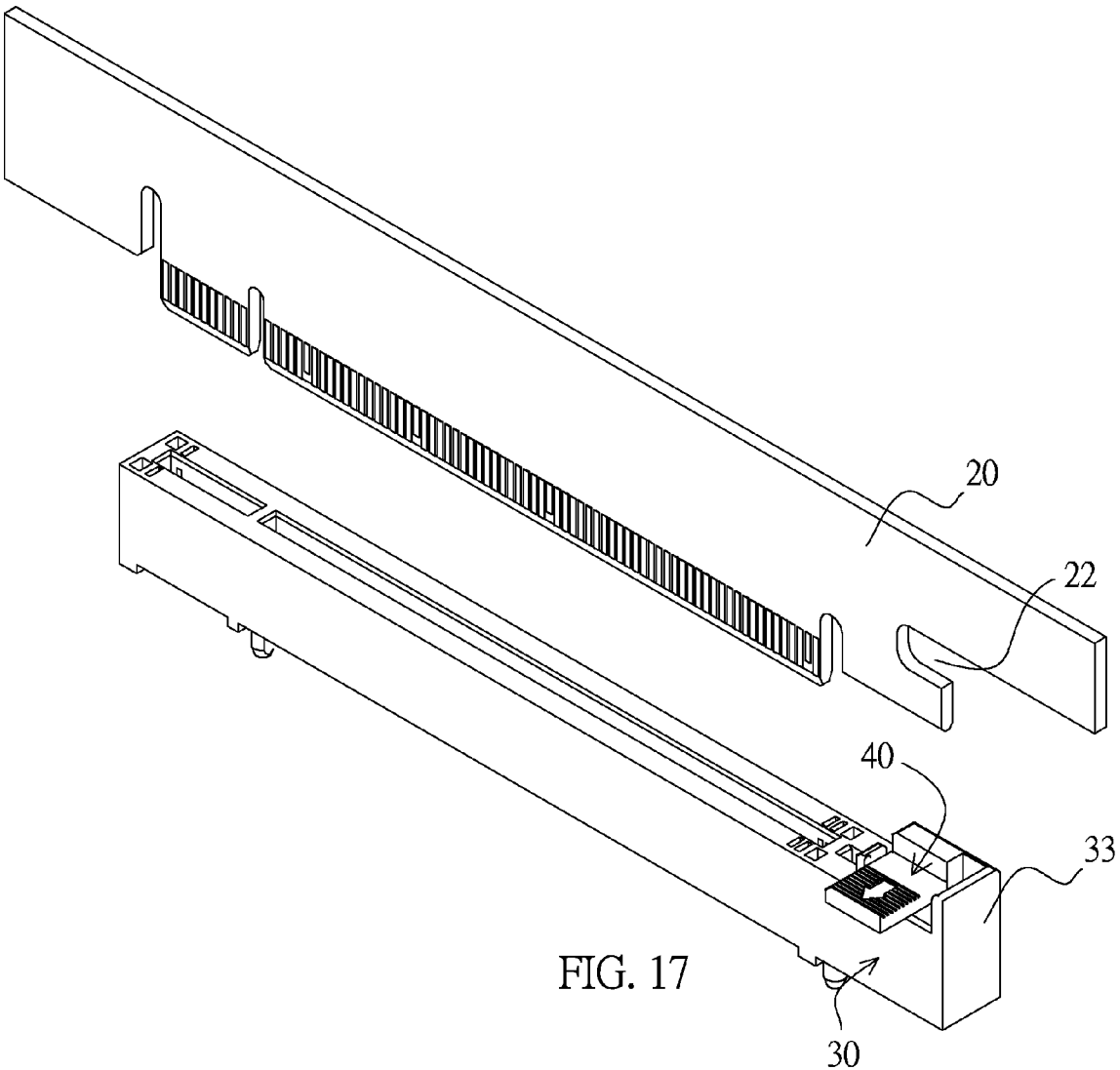
FIG. 17 is a pictorial view showing a third embodiment of the invention without any inserted circuit board.
Figure 19:
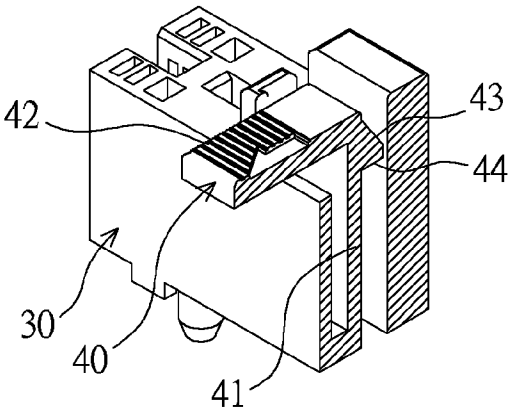
FIG. 19 is a pictorially cross-sectional view showing the third embodiment of the invention.
Figure 18:
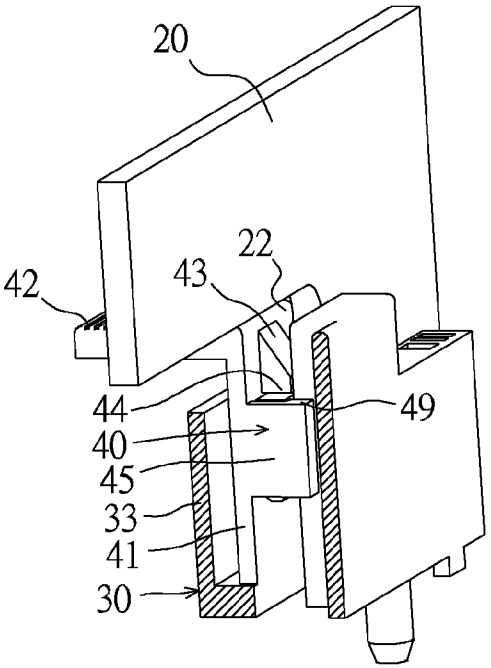
FIG. 18 is a pictorial view showing that the circuit board is inserted into the positioning state according to the third embodiment of the invention.

As shown in FIGS. 17 to 19, the third embodiment of the invention is almost the same as the second embodiment except that the third embodiment is a video card connector (e.g., PCI EXPRESS) to be connected to the circuit board 20, which is a video card. The circuit board 20 has the notch 22 formed on only one side. This embodiment only has one engaging member 40. Only one side of the plastic base 30 is formed with a supporting seat 33. The engaging member 40 and the plastic base 30 are integrally formed by way of injection molding and are disposed in the supporting seat 33. The engaging member 40 similarly has an elastic arm 41. The elastic arm 41 has, from top to bottom, a handle 42, a guide-in inclined surface 43, an engaging portion 44 and an elastic member 45. The outer end of the elastic member 45 is formed with a hook 49. The elastic arm 41 elastically moves in the direction (hereinafter referred to as the plate surface direction) toward or away from the plate surface of the circuit board.

Figure 20:
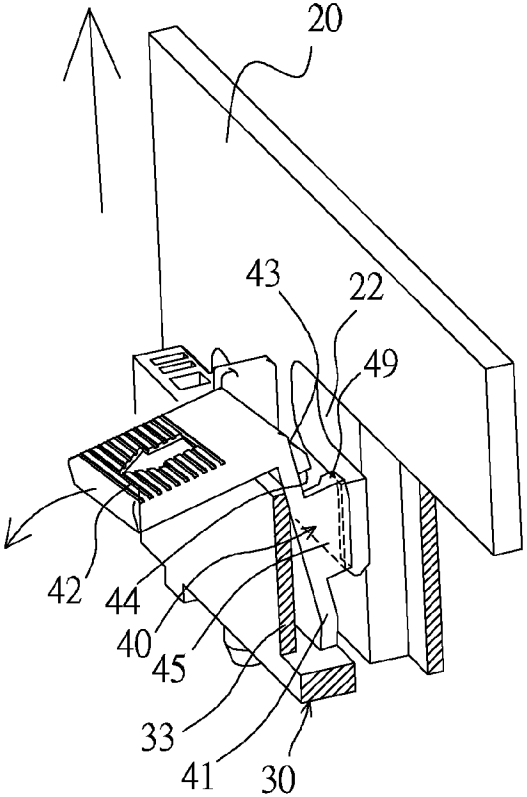
FIG. 20 is a pictorial view showing that the circuit board is taken out according to the third embodiment of the invention.

As shown in FIG. 18, when the circuit board 20 is inserted to a predetermined position, the notch 22 on one side thereof is engaged with the engaging portion 44 of the engaging member, and the hook 49 of the elastic member 45 is disposed on one surface of the circuit board 20. As shown in FIG. 20, when the circuit board is to be taken out, the handle 42 is moved to make the elastic arm 41 elastically move outwardly from the plate surface direction of the circuit board, so that the engaging portion 44 is separated from the notch 22 of the circuit board. When the hook 49 of the elastic member is separated from one surface of the circuit board, it elastically moves back to press the other surface of the circuit board, so that the engaging member 40 cannot elastically move back to engage with the notch 22 of the circuit board. At this time, the handle 42 can be released and the circuit board 20 may be pulled out.

Figure 21:
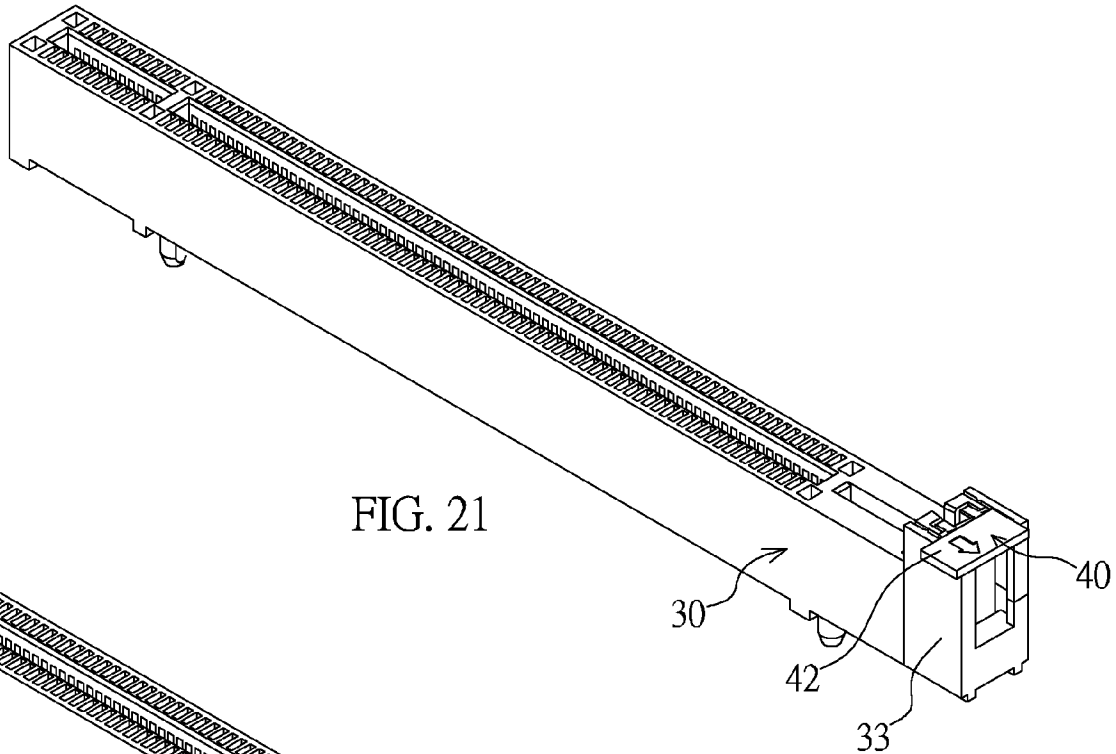
FIG. 21 is a pictorial view showing a fourth embodiment of the invention.

As shown in FIG. 21, the fourth embodiment of the invention is almost the same as the third embodiment except that the moving direction of the engaging member 40 of the fourth embodiment is the same as the lateral moving direction of the second embodiment. The handle 42 of the engaging member 40 only projects beyond one end in the front-to-rear direction of the plastic base 30.

Figure 22:
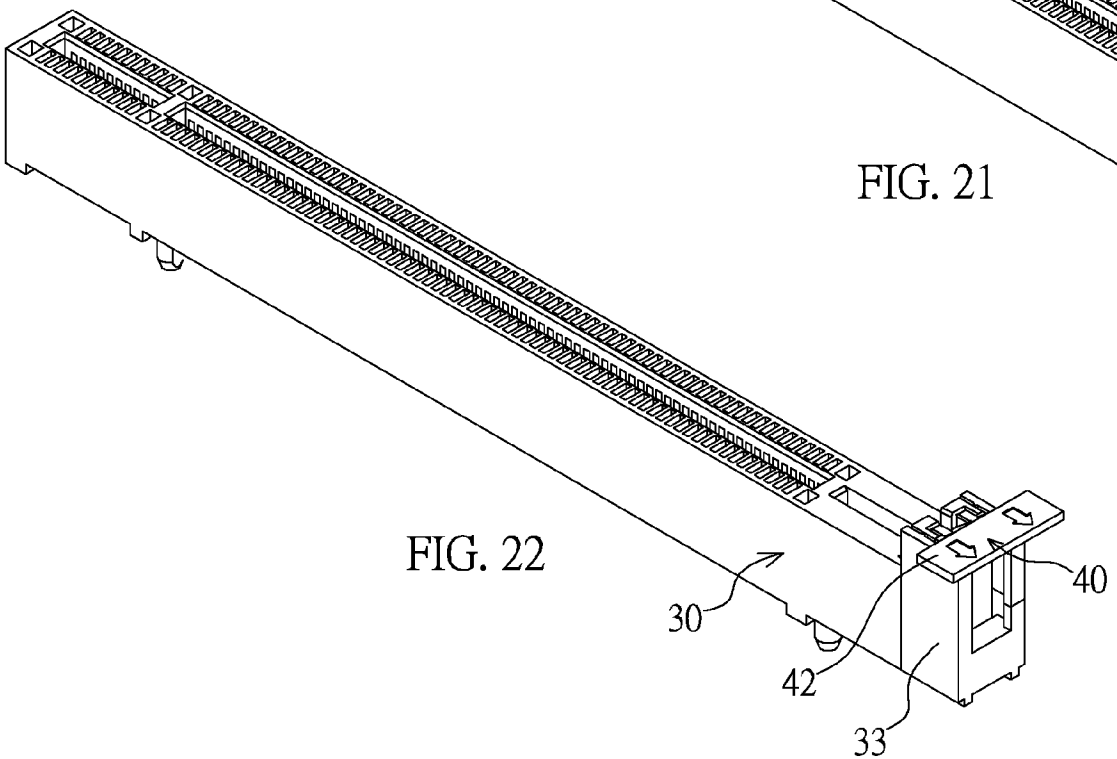
FIG. 22 is a pictorial view showing a fifth embodiment of the invention.

As shown in FIG. 22, the fifth embodiment of the invention is almost the same as the fourth embodiment except that the handle 42 of the engaging member 40 of this embodiment projects beyond two ends in the front-to-rear direction of the plastic base 30.

While the invention has been described by way of examples and in terms of preferred embodiments, it is to be understood that the invention is not limited thereto. To the contrary, it is intended to cover various modifications. Therefore, the scope of the appended claims should be accorded the broadest interpretation so as to encompass all such modifications.

What is claimed is:

1. An electrical connector, comprising:

a plastic base, which extends longitudinally and has a longitudinally extended connection slot, wherein the connection slot may be connected to a circuit board having one side formed with a notch; and an engaging member, which is disposed on one side of the plastic base and has an elastic arm, wherein:

the elastic arm has a handle, a guide-in inclined surface, an engaging portion and at least one elastic member;

when the circuit board is inserted into the connection slot, the one side of the circuit board presses the guide-in inclined surface to make the elastic arm elastically move outwardly and to make the at least one elastic member move elastically;

when the elastic arm elastically moves back, the engaging portion engages with the notch of the circuit board and the circuit board is in an inserted state; and when the handle is moved to make the elastic arm elastically move outwardly and to disengage the engaging portion from the notch of the circuit board, the circuit board is still in the inserted state, and the at least one elastic member can stop the engaging member from elastically moving back so that the engaging portion cannot engage with the notch, wherein the engaging member elastically moves back after the circuit board is taken out.

2. The electrical connector according to claim 1, wherein:

when the circuit board is inserted to a predetermined position, the elastic member elastically presses one surface of the circuit board;

when the handle is moved to make the elastic arm elastically move outwardly and make the engaging portion be separated from the notch of the circuit board, one surface of the elastic member separated from the circuit board elastically moves back to press an engaging edge on the one side of the circuit board.

3. The electrical connector according to claim 1, wherein a top end of the at least one elastic member has a guide-in inclined surface.

4. The electrical connector according to claim 1, wherein the at least one elastic member comprises two opposite elastic members.

5. The electrical connector according to claim 1, wherein another engaging member, which is the same as the engaging member, is disposed on the other side of the plastic base.

6. The electrical connector according to claim 1, wherein:

when the circuit board is inserted to a predetermined position, the at least one elastic member is disposed on one side of the circuit board; and when the handle is moved to make the elastic arm elastically move outwardly in a plate surface direction of the circuit board to separate the engaging portion from the notch of the circuit board, the elastic member is separated from one surface of the circuit board and elastically moves back to press the other surface of the circuit board.

7. The electrical connector according to claim 1, wherein:

the plastic base has a stopping surface; and when the engaging member is moved to elastically move outwardly, the engaging member may be stopped by the stopping surface so that the engaging member cannot be over moved.

8. The electrical connector according to claim 1, wherein the engaging member is made of a metal material, and has one end formed with a fixing portion, one side of the plastic base is formed with a supporting seat, and the fixing portion of the engaging member is fixed to the supporting seat.

9. The electrical connector according to claim 8, wherein a bottom of the engaging portion of the engaging member is formed with a longitudinal through hole, and a bottom of the notch of the circuit board engages with the longitudinal through hole when the engaging portion engages with the notch of the circuit board.

10. The electrical connector according to claim 1, wherein the engaging member is made of a plastic material, and the engaging member and the plastic base are integrally formed by way of injection molding.

11. The electrical connector according to claim 10, wherein:

one side of the plastic base has at least one engaging point;

when the circuit board is inserted into a predetermined position, the at least one elastic member elastically presses one surface of the circuit board; and when the handle is moved to make the elastic arm elastically move outwardly and separate the engaging portion from the notch of the circuit board, the at least one elastic member is engaged with the at least one engaging point, so that the engaging member cannot elastically move back and engage with the notch of the circuit board.

12. The electrical connector according to claim 1, wherein the engaging member extends in a vertical direction, a bottom end of the engaging member is fixed to the plastic base, and the engaging portion is disposed below the guide-in inclined surface.

13. The electrical connector according to claim 12, wherein the handle of the engaging member is disposed on a top end of the elastic arm and projects outwardly.

* * * * *